United States Patent [19]

Poirier

[11] Patent Number: 4,480,837

[45] Date of Patent: Nov. 6, 1984

[54] MARITIME GAME

[76] Inventor: Kerry L. Poirier, Box 2145, Columbia Falls, Mont. 59912

[21] Appl. No.: 461,121

[22] Filed: Jan. 26, 1983

[51] Int. Cl.[3] ..... A63F 3/00

[52] U.S. Cl. ..... 273/252; 273/255

[58] Field of Search ..... 273/255, 262, 243, 251, 273/252, 253

[56] References Cited

U.S. PATENT DOCUMENTS

| | | | |
|---|---|---|---|
| 443,604 | 12/1890 | Todd | 273/243 |
| 972,382 | 10/1910 | Johnson-Jervis . | |
| 1,254,380 | 1/1918 | Whitmore . | |
| 1,294,256 | 2/1919 | George | 273/262 |
| 1,315,483 | 9/1919 | Edwards . | |
| 1,526,602 | 2/1925 | Kuehn et al. | 273/255 X |
| 2,277,301 | 3/1942 | Channer . | |
| 2,414,165 | 7/1944 | Paschal . | |
| 2,964,323 | 12/1960 | Moses | 273/255 |
| 3,659,852 | 5/1972 | Redict | 273/253 |
| 4,226,419 | 10/1980 | Wooden . | |

FOREIGN PATENT DOCUMENTS

| | | | |
|---|---|---|---|
| 14317 | of 1902 | United Kingdom | 273/262 |

*Primary Examiner*—Richard C. Pinkham

*Assistant Examiner*—Scott Brown

*Attorney, Agent, or Firm*—Graybeal & Cullom

[57] ABSTRACT

Maritime board game involving competing ship/marker playing pieces, each carrying removable cargo units and moved from respective home ports about a closed circuit cruise route comprising various event positions variously labeled "card", "mine", collision", and "missile", with certain positions left blank, and with each "missile" position being connected by a missile flight path line to a generally opposite blank position, the play of the game involving a "hit" being scored, with loss of a cargo unit from a given ship/marker, in the event the ship/marker stops on a "mine" position, or is on a blank position connected by a missile flight path line to a "missile" position occupied by a competing ship/marker, unless a respective "mine sweeper" or "intercept" card has been previously drawn by the owner of the ship/marker from a deck of event cards, which event cards are drawn upon the ship/marker stopping at a "card" position. Game play also requires that when two competing ship/markers stop on a "collision" position both must return to their respective home ports and begin the cruise course again. The game is won by the first ship/marker completing the course route and returning to its home port with at least one cargo unit.

18 Claims, 2 Drawing Figures

MARITIME GAME

BACKGROUND OF THE INVENTION

1. Field of the Invention

Maritime board game with ship/marker playing pieces each carrying plural removable cargo units, each such ship/marker being movable along closed circuit cruise route positions circumferentially arranged on a game board and bearing event designations, certain of which positions involve "hits" scored by removal of a cargo unit from the ship/marker, unless the "hit" is avoided by the player who owns that ship/marker having previously drawn a "hit" avoidance card when the ship/marker was stopped on one of certain other cruise course positions.

2. Description of the Prior Art

Naval board games are known involving ship/markers or the like moving from a home port and remaining in play in spite of more than a single "hit" from an opponent, such as in Johnson-Jervis U.S. Pat. No. 972,382. However, in the Johnson-Jervis game, "hits" are recorded by adding a ring to the marker and the play of the game includes the concept of a vessel withdrawing from engagement and returning to home port for repairs. Moreover, the Johnson-Jervis game differs from that of the present invention in that in it the movement of markers is not restricted to the perimeter of the board, i.e. to a single, closed circuit cruise route, and, the number of spaces which each marker moves is predetermined by the type of marker it is, and each player has different types of markers. Wooden U.S. Pat. No. 4,226,419 discloses a strategy game involving movement of markers on a chess type board, with the moves allowed each marker predetermined by a permanently affixed vector pattern displayed on the marker, in combination with pins which are settable into the marker to alter the permanent vector pattern in specific ways. Scoring against an opponent is by maneuvering one of the markers to align its vectors directly with the vectors of an opponent's marker, and pin placement in the marker is not a means of recording hits nor is movement of the Wooden markers restricted to a single closed circuit course path arranged circumferentially of the board. The Wooden game is designed for play by only two players and pieces are movable in multiple directions.

Whitmore U.S. Pat. No. 1,254,380, Edwards U.S. Pat. No. 1,315,483, Channer U.S. Pat. No. 2,277,301 and Paschal U.S. Pat. No. 2,414,165 are of general interest in that they relate to naval or warfare board games. However, none of these games utilizes markers with removable pins for "hit" scoring purposes and all include boards designed so that the markers can be moved over the entire board surfaces. It is also a characteristic of these games that game players may have more than one kind of marker, each of which functions in a distinctly different manner.

SUMMARY OF THE INVENTION

The invention involves a maritime game wherein markers have removable cargo units for scoring of "hit" events by removal of the cargo units, with such markers being used in play of the game in combination with a closed circuit cruise route arrangement of route positions coursed by the markers in going from a home port and returning to the same home port, coupled with missile flight paths from certain cruise route positions to generally opposite cruise route positions. The game provides a unique and especially advantageous way of simulating maritime battle activity, it being a characteristic and interesting feature of the game in this regard that during any given turn and roll of the die by any given player, the possibilities include a given ship/marker being the attacker (launching a missile from a "missile" position), being attacked (stopping at a "mine" position or occupying a missile flight path termination position and possibly being able to defend against such an attack by possession of a "mine sweeper" card or an "intercept" card, respectively), or simply being passive (by stopping at a blank position unless such blank position terminates a missile flight path on which a missile is fired by another ship/marker).

These and other objects, features, advantages and characteristics of games involving the apparatus and method of play of the present invention will be apparent from the accompanying drawings and following description relating to preferred embodiments thereof, as presently contemplated by applicant.

DESCRIPTION OF THE PREFERRED EMBODIMENT

Figure 1:
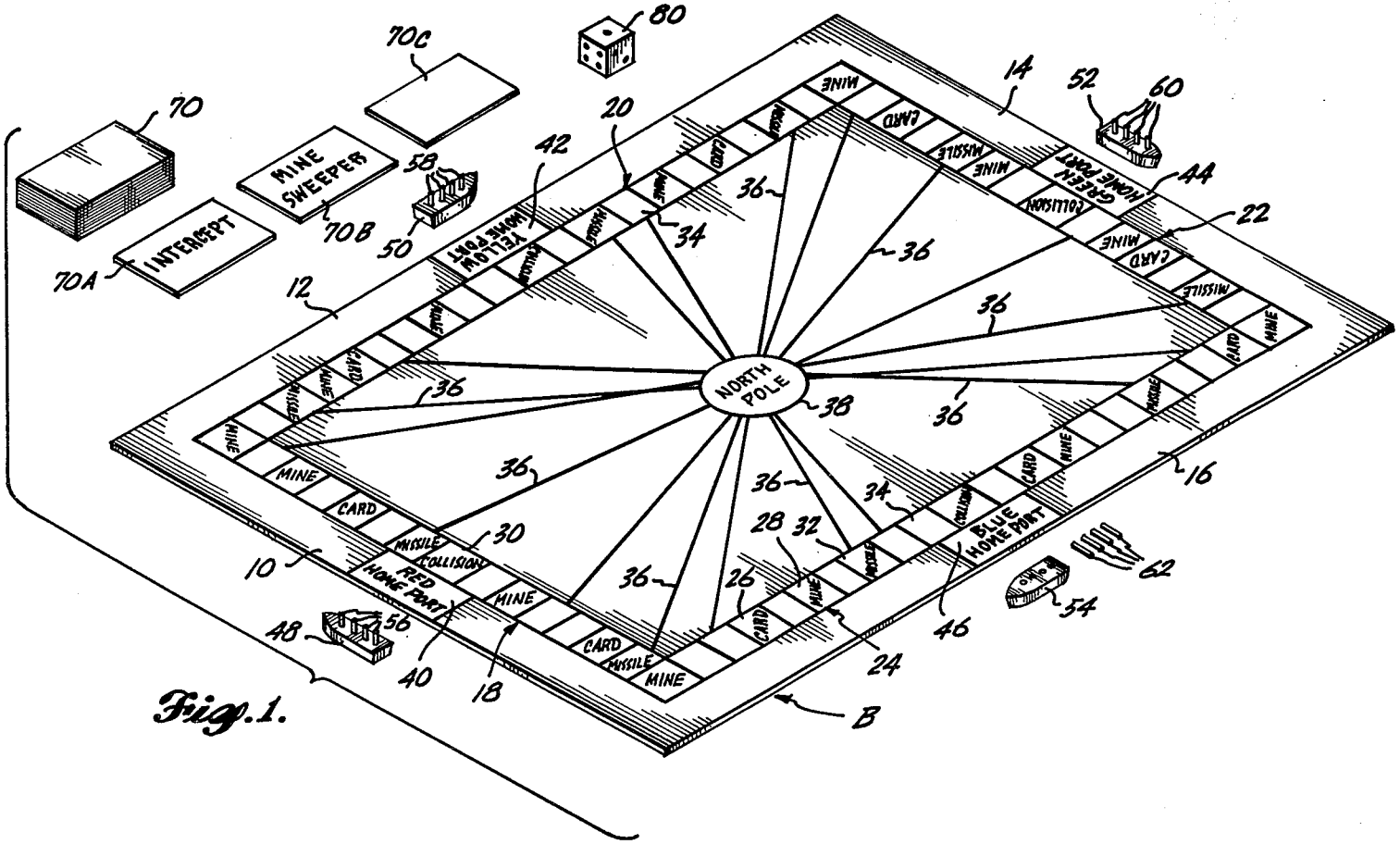
FIG. 1 is an isometric view of a game board, along with the removable cargo unit equipped, ship/marker type playing pieces, the deck of event cards, and the conventional die used therewith, all of which constitute the apparatus involved in the preferred embodiment of the present invention.
Figure 2:
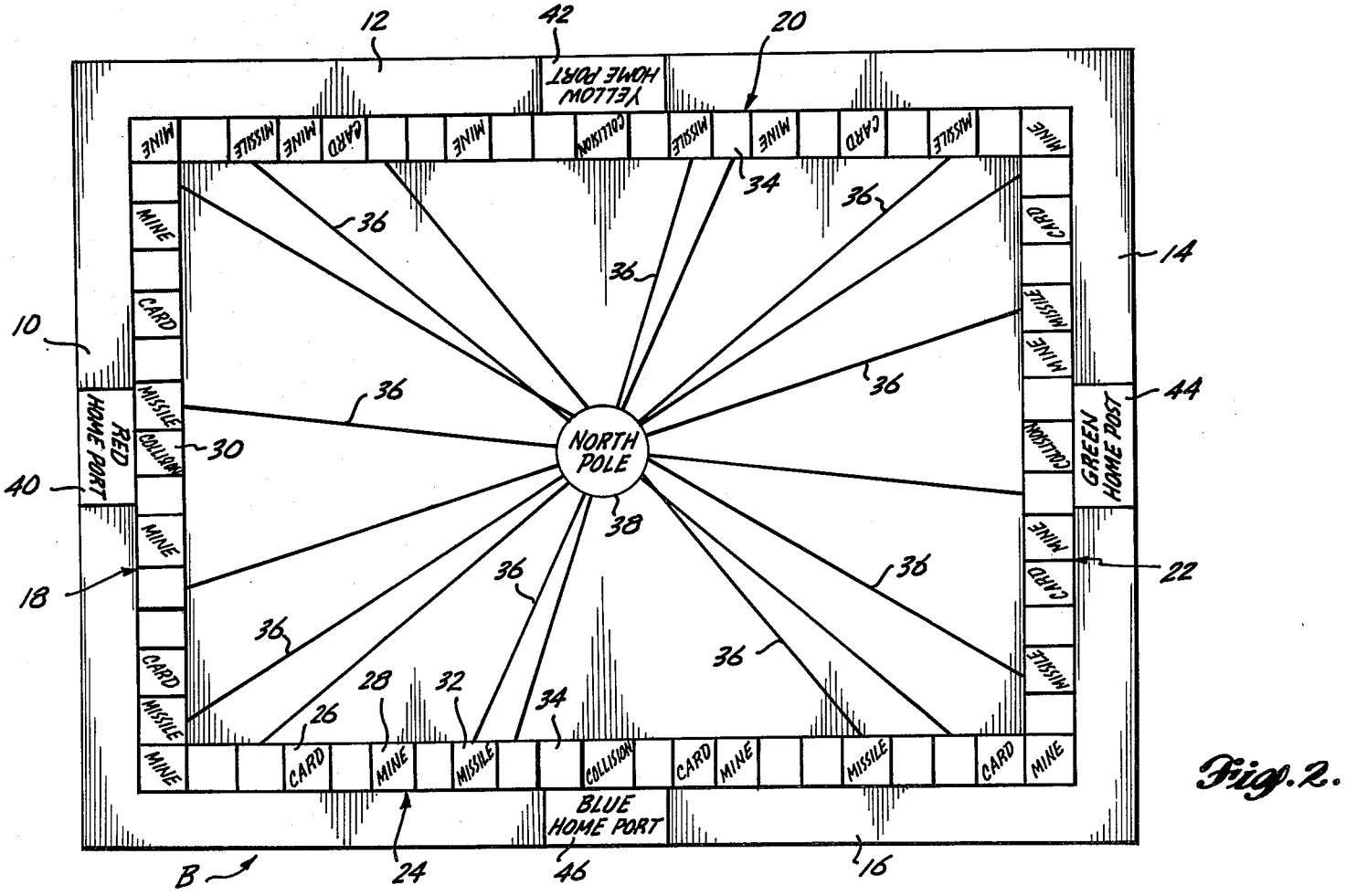
FIG. 2 is a plan view of the game board shown in FIG. 1, on a larger scale.

Referring now to FIGS. 1 and 2, the game board generally indicated at B comprises four sides 10, 12, 14, 16, and a closed circuit cruise route or course, made up of four interconnected sides or leg portions 18, 20, 22, 24, arranged along respective board side portions 10, 12, 14, 16, the cruise route and its portions 18, 20, 22, 24 being made up of a series of event positions or squares, certain of which are marked, in a generally random manner with "card", "mine", "collision", and "missile" event designations, and with no such designation being next to any like position designation. In the preferred embodiment shown, these positions are arranged as labeled in FIGS. 1 and 2 and respectively there indicated by numerals 26, 28, 30, 32. Also, certain of the route positions are left blank, as shown, and as indicated by the numeral 34 in certain instances. Each "missile" cruise position or square 32 has leading therefrom a missile flight path line 36 which extends across the board to a blank position 34 on the side opposite the "missile" position, with the central portion of the board (the area where the missile flight path lines 36 intersect) being designated the North Pole as indicated at 38, which provides general board simulation and suggestion that the cruise route is around the world and the missile flight paths pass over the North Pole.

Game board B further comprises distinctively colored home port locations along each side of the cruise route, with home port location 40 in the middle of cruise route leg 18 being designated the "red home port", with home port location 42 located in the middle of cruise route leg 20 being designated "yellow home port", with home port location 44 in the middle of cruise route leg 22 being designated "green home port", and with home port location 46 in the middle of cruise route leg 24 being designated "blue home port". At or in association with each of the respective home ports 40, 42, 44, 46 is a respective ship/marker 48, 50, 52, 54 of respectively like color, and each of the competing ship/markers 48, 50, 52, 54 is provided with or has associated therewith a set of four cargo units, in the form of plastic pins or the like, respectively indicated at 56, 58, 60, 62, which are snugly fitted into holes in and are thus carried by the respective ship/marker units 48, 50, 52, 54 in the course of the play of the game.

Associated with the game board B and as part of the game apparatus typifying games of the present invention as illustrated in FIGS. 1 and 2, is a group or deck of what are termable event cards, generally indicated at 70, certain of which cards are labeled "intercept" as shown in FIG. 1 by the representative card 70A, certain of which are labeled "mine sweeper", as shown in FIG. 1 by the representative card 70B, and certain of which are left blank as shown in FIG. 1 by the representative card 70C. As will be understood, the group or deck of event cards 70 which may total thirty-two in number, for example, are arranged in a random manner, as by shuffling, and are available face down to the game players in the course of the play of the game, and are returned to the bottom of the deck by the players as used by each player in the course of the play of the game.

To determine the number of cruise course positions a given ship/marker is to be moved during a given turn of play, each player having a ship/marker in turn manipulates a controlled probability random number generator, the game apparatus shown in FIG. 1 including for this purpose a conventional six-sided die 80.

The play of the game starts by each of the several persons playing the game selecting a ship/marker 48, 50, 52 or 54 and its associated cargo units, and placing the selected ship/marker on the like colored home port 40, 42, 44 or 46. Each game player in turn then rolls the die 80 and moves his or her ship marker the number of cruise route positions determined by the number of spots showing at the top of the die 80, and undertakes the action, if any, dictated by the route position on which the ship/marker stops. If the ship/marker comes to rest on a route position 26 bearing a "card" designation, the player takes a card from the top of the deck 70 of event cards and if the taken card is a blank card 70C, no further action is called for except that the player returns the blank card 70C to the bottom of the deck 70, face down. If the taken card is an "intercept" card 70A or a "mine sweeper" card 70B, the player then keeps the card in reserve for possible use during the further course of the game. If the ship/marker falls on a "mine" route position 28, the ship/marker is considered "hit" and the player removes one of the four cargo units being carried by his or her ship/marker, e.g. one of the cargo units 56 from ship/marker 48, for example, unless that player at that time holds a "mine sweeper" card 70B in which case the "hit" is considered avoided by the ship/marker, the card 70B is returned face down to the bottom of the event card deck 70, and a cargo unit is not removed from the ship/marker. At such time as a ship/marker stops on a "missile" cruise route position 32, it is assumed that it thereupon fires a missile along the missile flight path line 36 leading from that position and scores a "hit" on any ship/marker stopped on the blank cruise route position 34 at the end of that missile flight path 36, and the player owning the ship/marker occupying that blank position 34 must remove a cargo unit from that ship/marker unless that player then is a holder of an "intercept" event card 70A, in which case the player returns the intercept card 70A face down to the deck of event cards 70 and the ship/marker occupying the blank position 34 at the end of that missile flight path is considered to have avoided the "hit" and its owner does not have to remove a cargo unit from that ship/marker. If two ship/markers occupy a "collision" cruise route position 30 at the same time, both ship/markers are considered damaged and are immediately returned to their respective home ports and any then missing cargo units are restored to them, with each beginning along the cruise route again at such time as the player owning the ship/marker next rolls the die 80 in normal turn. In the event a given ship/marker receives and does not avoid sufficient "hits" to have lost all of its cargo units, it is then immediately returned to its home port and likewise is started along the cruise route again, with its set of cargo units restored, upon the next roll of the die in turn by the player owning that ship/marker. At such time as one ship/marker first completes the full cruise route and returns to its home base while still retaining at least one of its cargo units, it is declared the winner of the game and the game ends.

Various game rules may be adopted and may be varied from game to game. Preferably, for example, a given player may have a choice as to which direction to proceed on the first move onto the course route but thereafter must proceed in the same direction around the course route. Also, no given ship/marker may move off the course route into another ship/marker's home port, as might otherwise be attempted in order to avoid landing on a "collision" position 30.

Variations in the game apparatus will also readily occur to players and those skilled in the art to which the invention is addressed. Simply by way of further example, the function of die 80 as a contolled probability random number generator can be performed in a variety of ways, as by use of a conventional spinning arrow type number selector, or more than one die can be used to make play of the game more rapid, with rule variations such as loss of turn in the event of both dies showing the same number (i.e. "doubles"), if desired. As will also be apparent the layout of the board B can be such that a cruise route with other than four sides and other than four home ports can be involved, say three or six, and other home port and ship/marker colors can be employed, other than shown in FIGS. 1 and 2. Additionally, also, the number of cargo units carried as a full set of cargo units by each ship/marker can be more or less than the four employed in the preferred embodiment. As a matter of artistic layout, the board B shown in FIGS. 1 and 2 includes a centrally located "North Pole" which provides an around the world connotation to the closed circuit cruise route, and other artistic arrangements will also be evident, such as arranging the cruise route around a given continent or island, or simply showing only missile flight paths centrally of the cruise route. As will also be apparent, the game may be played by any given number of players, up to the number of home ports and ship/markers provided in any given board layout.

What is claimed is:

1. A maritime game board apparatus comprising; a game board having a closed circuit, single path cruise route which passes a series of home ports for respective competing ship/markers and includes a number of event positions, certain of which are labeled as "missile" positions, certain of which are labeled as "card" positions, and certain of which are blank; missile flight path lines each extending from a "missile" position on one side of the cruise route to a blank position on the opposite side of the cruise route; a controlled probability random number generator to determine the number of cruise course positions a given ship marker is moved during a given turn of play; competing ship/markers which are moved from position to position along the cruise route in the play of the game; removable cargo units carried by each of the ship/marker; and a group of event cards, certain of which are labeled "intercept" and certain of which are left blank, the play of the game involving possible removal of a cargo unit from a ship/marker occupying a blank position at such time as another ship/marker occupies a "missile" position connected by a missile flight path line between such "missile" position and the occupied blank position, and the play of the game further involving the avoidance of the loss of a cargo unit by the ship/marker occupying the blank position and the owner of such ship/marker is the holder of and returns an "intercept" card.

2. The maritime game board apparatus according to claim 1, wherein certain of the positions along the cruise route are "mine" positions and the play of the game involves possible loss of a cargo unit by a ship/marker stopping on such "mine" position.

3. A maritime game board apparatus according to claim 2, wherein the play of the game involves the owner of a given ship/marker drawing an event card from the group of event cards, certain of which are labeled "mine sweeper" cards and the play of the game further involves the avoidance of loss of a cargo unit by the owner's ship/marker when the ship/marker is stopped on a "mine" position and the owner of the ship/marker is the holder of and returns a "mine sweeper" card.

4. A maritime game board apparatus according to claim 1, wherein certain positions along the cruise route are "collision" positions and the play of the game is such that, when two competing ship/markers stop on any such "collision" position at the same time, both are returned directly to their respective home ports and must begin the cruise route again.

5. A maritime game board apparatus according to claim 4, wherein each such "collision" position on the cruise route is next to a home port.

6. A maritime game board apparatus according to claim 1, wherein the game board layout involves four distinctively colored home ports, four correspondingly colored ship/markers, and each such ship/marker is designed to carry up to four removable cargo units.

7. A maritime game board apparatus according to claim 1, wherein the closed circuit cruise route surrounds a centrally placed showing of the North Pole, giving the impression that the cruise route is around the world in nature.

8. A maritime game board apparatus according to claim 7, wherein the closed circuit cruise route is arranged in generally rectangular pattern and each missile flight path line extends from a missile position on one side of the route to a blank position on the opposite side of the cruise route.

9. A maritime game board apparatus according to claim 8, wherein the respective home ports are centrally placed on each side of the cruise route.

10. A maritime game board apparatus according to claim 9, wherein a "collision" position is centrally placed on each side of the cruise route and each home port is outwardly placed next to and spans one of the "collision" positions and also substantially spans two blank positions next to the "collision" position.

11. A maritime game board apparatus according to claim 1, wherein no "missile" or "card" position is next to any like position.

12. Maritime game apparatus involving plural ship/-markers which leave and return to home port in the course of playing the game, said game apparatus comprising:

(a) a game board with plural sides and a closed circuit, single path cruise route extending circumferentially of the board along the sides thereof and made up of a series of event positions, certain of which are marked, in a generally random manner, with "card", "mine", "collision", and "missile" event designations, and certain of which are left blank, said game board further comprising lines designating missile flight paths and each extending from a "missile" event position on the cruise route to a blank cruise route position across the board, said game board further comprising a distinctively colored home port position along each side of the cruise route;

(b) a deck of event cards, certain of which are labeled "intercept", certain of which are labeled "mine sweeper", and certain of which are left blank;

(c) a plurality of distinctively colored ship/markers, each in the general configuration of a marine vessel and each being equipped with a plurality cargo units which are removable for "hit" scoring purposes; and (d) a controlled probability random number generator to determine the number of cruise course positions a given ship marker is moved during a given turn of play; the manner of play of the game involving several persons each selecting a distinctively colored home port and associated ship/-marker of like color equipped with a full set of cargo units, with each game player in sequence manipulating the random number generator to determine the number of positions the ship/marker is to be moved along the cruise route and moving the player's ship/marker along the cruise route the number of event positions determined by the roll of the generator, the game action at each event position being as follows: if a given ship/marker movement stops on a route position bearing a "card" designation, the player takes a card from the top of the deck of event cards and if the taken card is blank, no further action is necessary except that the card is returned to the bottom of the deck of event cards; if the card bears a designation "intercept" or the designation "mine sweeper", the player then keeps the card in reserve for possible use during the further course of the game; if the ship/marker falls on a route position designated "mine", a "hit" is considered scored against the ship/marker and the player removes one cargo unit from the player's ship/marker unless the player holds a "mine sweeper" card in which case no "hit" and loss of a cargo unit is involved; if two ship/markers stop at the same time on a cruise route position designated "collision", both ship/markers are returned to their respective home ports and begin the cruise route again with any missing cargo units restored; if a ship/marker stops on a cruise route position designated "missile", it is considered to thereupon fire a missile along the flight path leading from that position and to score a "hit" on any ship/marker stopped on a blank cruise route position at the end of the missile flight path, and such a "hit" involves loss of a cargo unit by the ship/marker "hit" unless the player having that ship/marker is the holder of an "intercept" card, in which case the ship/marker at the end of the missile flight path is considered to have avoided the "hit"; if a ship/marker stops on a blank cruise route position, no further action is involved unless such ship/marker is unfortunate enough to receive a missile "hit" while occupying such position and doesn't have an "intercept" card to offset the "hit"; if a ship/marker has received sufficient "hits" to have lost all its cargo units it is returned to its home port and, upon the next turn for the player owning the ship/marker to roll the die, is started along the cruise route again, with its set of cargo units restored; and when one ship/-marker completes the full cruise route and returns to its home base while still retaining at least one cargo unit it thereupon becomes the winner of the game and the game ends.

13. A maritime game board apparatus according to claim 12, wherein the random number generator is a die.

14. A maritime game board apparatus according to claim 12, wherein the game board layout involves four distinctively colored home ports, four correspondingly colored ship/markers, and each such ship/marker is designed to carry up to four removable cargo units.

15. A maritime game board apparatus according to claim 14, wherein the closed circuit cruise route surrounds a centrally placed showing of the North Pole, to give the impression that the cruise route is around the world in nature.

16. A maritime game board apparatus according to claim 15, wherein the closed circuit cruise route is arranged in generally rectangular pattern and each missile flight path line extends from a missile position on one side of the route, through the area of the North Pole, and to a blank position on the opposite side of the cruise route.

17. A maritime game board apparatus according to claim 16, wherein the respective home ports are centrally placed on each side of the cruise route.

18. A maritime game board apparatus according to claim 17, wherein a "collision" position is centrally placed on each side of the cruise route and each home port is outwardly placed next to and spans one of the "collision" positions and also substantially spans two blank positions next to such "collision" position.

* * * * *